US006299297B1

(12) United States Patent
Beeson

(10) Patent No.: US 6,299,297 B1
(45) Date of Patent: Oct. 9, 2001

(54) COMPACTING EMPTY INK CONTAINERS

(75) Inventor: Robert R. Beeson, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 1559 days.

(21) Appl. No.: 08/548,696

(22) Filed: Oct. 27, 1995

Related U.S. Application Data

(63) Continuation of application No. 08/136,172, filed on Oct. 12, 1993, now abandoned.

(51) Int. Cl.[7] ..... B41J 2/175
(52) U.S. Cl. ..... 347/86
(58) Field of Search ..... 222/95, 103, 107, 222/92; 347/84, 85, 86

(56) References Cited

U.S. PATENT DOCUMENTS 3,260,412 * 7/1966 Larkin .
4,196,030 * 4/1980 Ausnit .
4,383,263 5/1983 Ozawa et al. .
4,422,084 12/1983 Saito .
4,447,820 5/1984 Terasawa .
4,496,959 1/1985 Frerichs .
4,551,734 * 11/1985 Causley et al. .
5,323,932 * 6/1994 Bauman .
5,497,911 * 3/1996 Ellion et al. .
5,827,164 * 10/1998 Tomic .

FOREIGN PATENT DOCUMENTS 2831973 1/1980 (DE) .
3501399 8/1985 (DE) .

OTHER PUBLICATIONS

Webster's II New Riverside University Dictionary. Eds. Annett. Soukhanov et al. Boston, MA: Houghton Mifflin Company, 1988. (p. 487 fleshpot–flippant).*

* cited by examiner

*Primary Examiner*—Raquel Yvette Gordon

(57) ABSTRACT

Catch mechanisms are provided on the interior surfaces of a flexible, collapsible ink container. The catch mechanisms secure the empty container in a compact orientation for easy handling.

4 Claims, 1 Drawing Sheet

COMPACTING EMPTY INK CONTAINERS

CROSS REFERENCE TO RELATED APPLICATION(S)

This is a continuation of application Ser. No. 08/136,172 filed on Oct. 12, 1993, now abandoned.

TECHNICAL FIELD

This invention pertains to containers used for supplying ink to ink-jet printers.

BACKGROUND INFORMATION

One type of ink-jet printer includes a carriage that is reciprocated back and forth across a sheet of paper that is advanced through the printer. The reciprocating carriage holds a pen very close to the paper. The pen is controlled by the printer for selectively ejecting ink drops from the pen while the pen is reciprocated or scanned across the paper, thereby to produce characters or an image on the paper.

The pen carries a reservoir for holding a limited amount of ink. A relatively larger supply of ink is provided in a stationary container that is mounted to the printer. A tube is connected between the supply container and the pen. The tube conducts the flow of ink from the supply container to the pen for replenishing the pen reservoir as needed. Alternatively, the pen and supply container can be constructed so that the pen occasionally engages the supply container to draw ink from the container and thereby replenish the reservoir.

Use of a separate, stationary ink supply is advantageous for a number of reasons. For example, an empty supply container can be replaced with a filled container without also replacing the relatively costly pen.

Unless properly designed, ink supply containers can present problems in handling once they are emptied and removed from the printer. In this regard, the emptied bags may be difficult to compact for handling efficiently. Moreover, residual amounts of ink in the otherwise empty containers may be "pumped" out of an empty container if that container is permitted to expand and contract during handling. It is also important that emptied containers be easily recyclable.

SUMMARY OF THE INVENTION

This invention is directed to an ink supply container that, once emptied, is readily compacted into a configuration that is easy to handle, easy to recycle, and avoids the problem of expelling small amounts of residual ink during handling. A preferred embodiment of the invention includes an internal catch mechanism for securing the interior surfaces of a flexible container after those interior surfaces are brought together as a result of depletion of the ink in the container.

DESCRIPTION OF PREFERRED EMBODIMENTS

Figure 1:
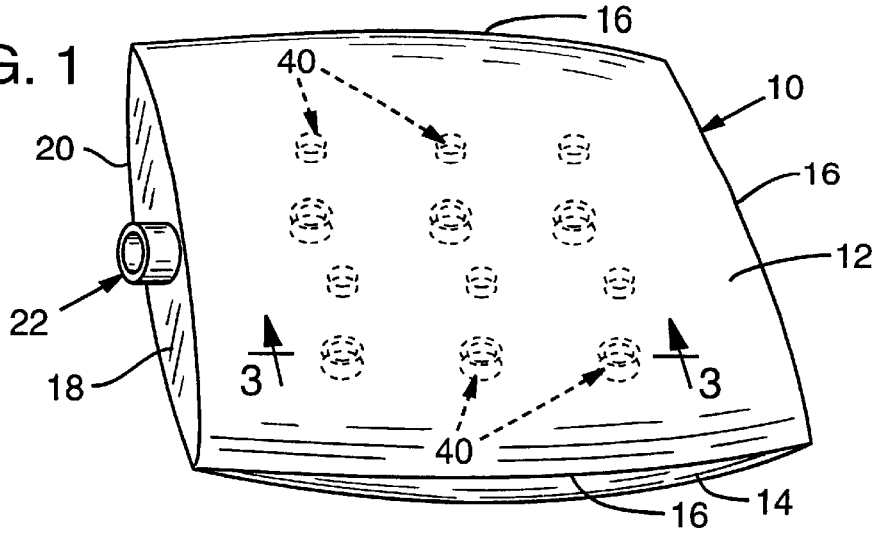
FIG. 1 is a perspective view of a filled ink supply container made in accordance with the present invention.

The container of the present invention is generally configured as a thin-walled bag or case 10 formed of high-density polyethylene. The case 10 may be formed by any of a number of techniques. For example, the case may comprise a flat top wall 12 and a generally flat bottom wall 14 having edges 16 that are heat-staked together.

At one end of the bag a front wall 18 has its edges 20 heat-staked to the corresponding edges of the top and bottom walls 12, 14. The front wall 18 provides a surface to which a valve mechanism 22 may be mounted, such as by heat-staking, to the case to permit filling and emptying of the container.

Figure 2:
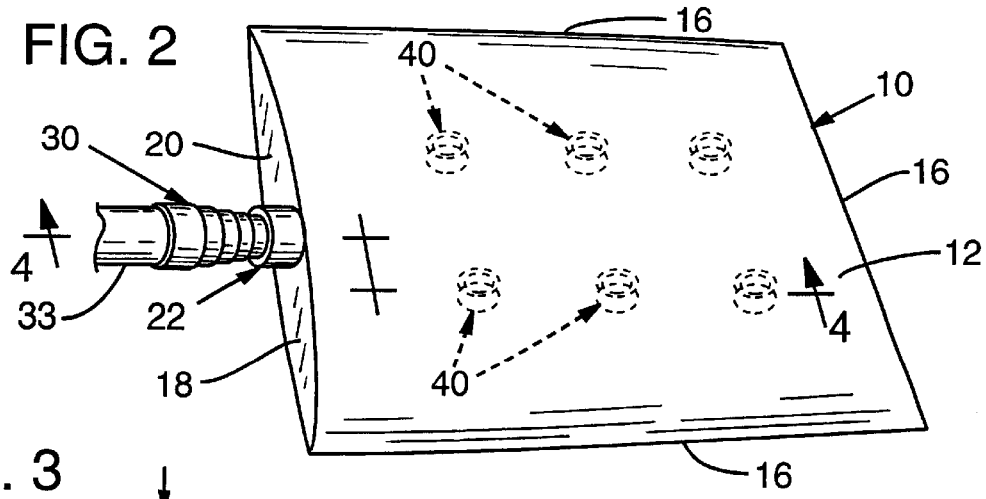
FIG. 2 is a perspective view of the ink container in a compacted orientation.
Figure 4:
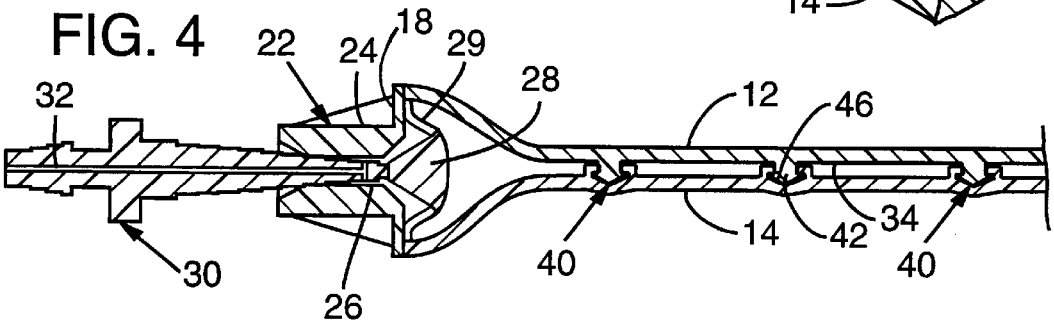
FIG. 4 is a partial section view taken along line 4—4 of FIG. 2.

As best shown in FIG. 4, the valve mechanism 22, which comprises no part of the present invention, includes a generally tubular connector 24. That has a central bore 26 therethrough. The inner end (to the right in FIG. 4) of the bore 26 is normally occluded by a plug 28 that is normally urged toward plugging the bore 26 by spring members 29 that are attached between the plug 28 and the coupler 24. In a preferred embodiment, the plug 28 is displaced from the bore 26 by a generally pointed coupler 30 that is inserted into the bore 26 of the connector 24. The coupler 30 has an internal passageway 32 for conducting ink out of the case 10 and into a tube 33 (FIG. 2) for feeding a pen reservoir.

Figure 3:
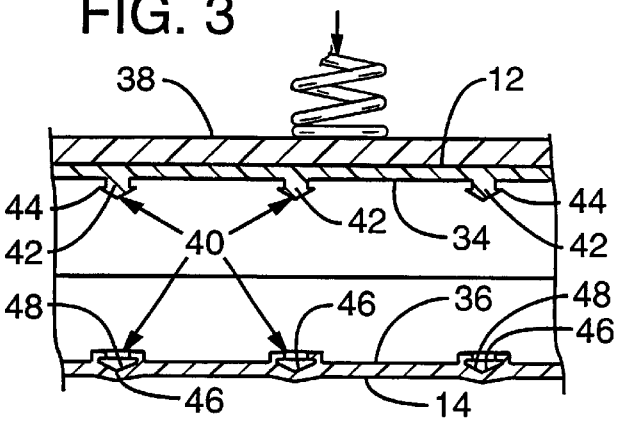
FIG. 3 is a partial section view taken along line 3—3 of FIG. 1.

During a printing operation, ink from the case 10 is depleted. As a result, the interior surface 34 (FIG. 3) of the top wall 12 and the opposed interior surface 36 of the bottom wall 14 are able to move toward one another. Movement of the surfaces 34, 36 toward one another may be facilitated by resilience of the flexible case 10, or by any suitable mechanism such as a spring-biased pressing member 38 depicted in FIG. 3.

In order to secure the opposing walls 12, 14 of the emptied container together, an internal catch mechanism 40 is provided on the opposing interior surfaces 34, 36 of the container. The catch mechanism 40 can take any of a number of configurations that are suitable for holding the walls 12, 14 of an empty case 10 together such as depicted in FIG. 4. In a preferred embodiment, the catch mechanism includes integrally formed posts 42 on the inner surface 34 of one wall 12. The outermost ends of the posts 42 are pointed and shaped to define barbs 44. Preferably, a plurality of posts 42 are generally evenly arrayed across the surface 34.

Another component of the catch mechanism 40 comprises an array of sockets 46 formed in the interior surface 36 of the bottom wall 14. Each socket defines a recess 48 generally conforming to the shape of the barbed outermost end of the posts 42. The sockets are arrayed to correspond to the array of posts 42 so that, as best shown in FIG. 4, one post 42 can be received and secured by a corresponding socket 46.

once the bag is completely empty and the post members 42 engaging sockets 46, the opposing walls 12, 14 are prevented from moving away from one another. Accordingly, the compacted empty container presents a generally flat configuration for easy and efficient handling of the empty ink containers.

Although the embodiment shown in the figures depicts an ink container with a normally-closed plug 28 (that is, closed when the coupler 30 is removed from the connector 24) it is contemplated that the catch mechanism 40 may be employed with any type of valve or connector for a flexible ink supply container. When the catch mechanism 40 is employed with ink containers that do not have a normally-closed connector

24, the securing action of the catch mechanism will prevent an emptied case from thereafter expanding and should the expanded empty case be compressed, causing any residual ink to be pumped out of the open end of the container.

Figure 5:
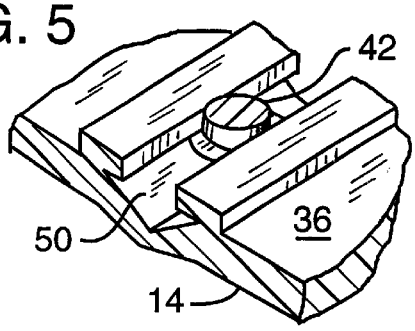
FIG. 5 is a partial detail view of an alternative catch mechanism for holding the container in a compacted configuration.

FIG. 5 shows a detail of an alternative socket configuration for a catch mechanism. Specifically, a post member 42 configured as described above is received in a socket 50 that defines a generally elongated recess having a transverse cross-sectional shape corresponding to that of the barbed post 42. The elongation of the socket 50 permits the catch mechanism to be placed in the secured position (as in FIG. 4) even though the top and bottom walls of the container may shift laterally (that is, into and out of the plane of FIG. 4) so that the relative position of the sockets 50 and posts 42 change.

The foregoing has been described in connection with preferred and alternative embodiments. It will be appreciated, however, by one of ordinary skill in the art that various modifications and variations may be substituted for the mechanisms described here while remaining defined by the appended claims and their equivalents.

The invention claimed is:

1. A method of compacting a flexible ink supply container that has opposing interior surfaces, the method comprising the steps of:

coupling the container to a reservoir of an ink-jet pen;

moving ink from the container to the coupled reservoir;

moving the opposing interior surfaces toward one another; and securing together the opposing interior surfaces thereby to prevent the opposing interior surfaces from thereafter moving apart.

2. The method of claim 1 wherein the securing step includes providing an array of spaced apart barbed members on a first interior surface portion and an array of spaced apart socket members on a second interior surface portion and pressing the barbed members into the socket members.

3. The method of claim 1 including the step of forming the container to be resiliently flexible so that the opposing surfaces are not urged apart once the ink is moved from the container.

4. The method of claim 1 wherein the moving step includes continuously applying a pressing member to the container for pressing together opposing surfaces.

* * * * *